United States Patent [19]

Evans et al.

[11] Patent Number: 4,648,864

[45] Date of Patent: Mar. 10, 1987

[54] CENTRIFUGAL SEPARATOR AND METHOD OF SEPARATING BUOYANT PARTICLES FROM A LIQUID

[75] Inventors: Timothy J. Evans, Aurora; Richard J. Kooy, Woodridge, both of Ill.

[73] Assignee: Chicago Bridge & Iron Company, Oak Brook, Ill.

[21] Appl. No.: 686,592

[22] Filed: Dec. 26, 1984

[51] Int. Cl.[4] ..... B04B 11/08

[52] U.S. Cl. ..... 494/37; 62/354; 494/58

[58] Field of Search ..... 494/37, 2, 3, 4, 56, 494/57, 58, 59; 62/345, 346, 354

[56] References Cited

U.S. PATENT DOCUMENTS

| | | | |
|---|---|---|---|
| 503,731 | 8/1893 | Anderson | 494/37 |
| 1,545,832 | 7/1925 | Hoffbauer | 494/58 |
| 1,701,731 | 2/1929 | Schaum | 494/58 |

*Primary Examiner*—Robert W. Jenkins

*Attorney, Agent, or Firm*—Marshall, O'Toole, Gerstein, Murray & Bicknell

[57] ABSTRACT

A method of separating solid particles present in a liquid in which the solid particles float by subjecting the liquid to centrifugal force in a chamber thereby causing the solid particles to move radially inwardly and produce a pack of solid particles while the liquid freed of solid particles flows radially outwardly; continuously withdrawing liquid freed of solid particles from the chamber; and continuously removing solid particles from the pack.

Apparatus for centrifugal separation of solid particles from a liquid in which they are buoyant, comprising a chamber adapted to be rotated about an axis; a conduit to continuously feed liquid containing the solid particles to the chamber; a conduit to continuously withdraw liquid substantially free of solid particles from the chamber; and a scraper to continuously remove solid particles from a pack of solid particles which forms in the chamber as a result of centrifugal force when the chamber is rapidly rotated.

20 Claims, 6 Drawing Figures

FIG. 4
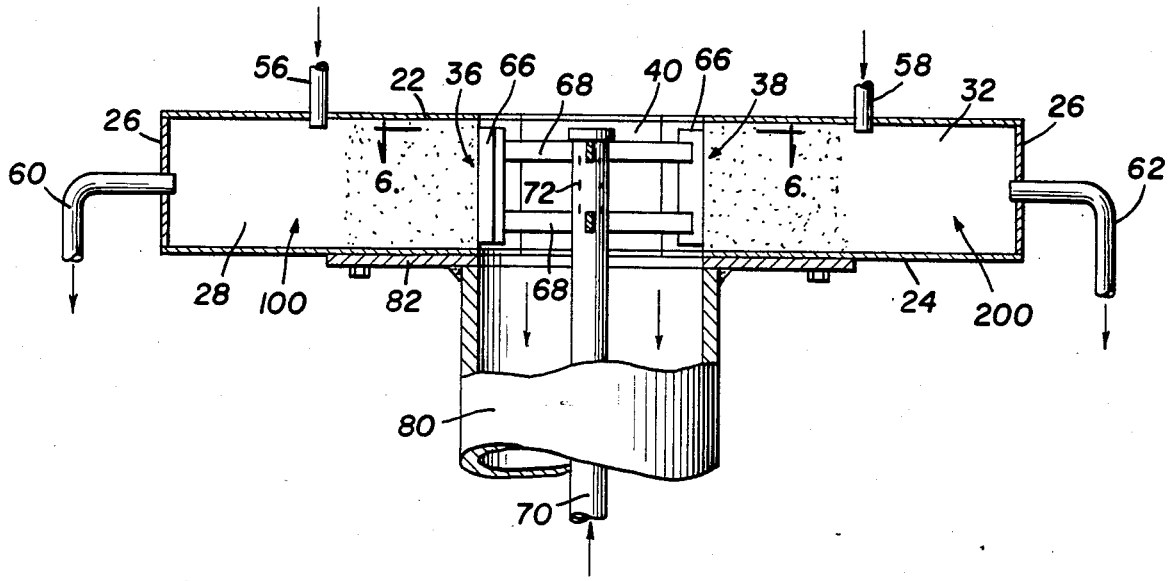
FIG. 5
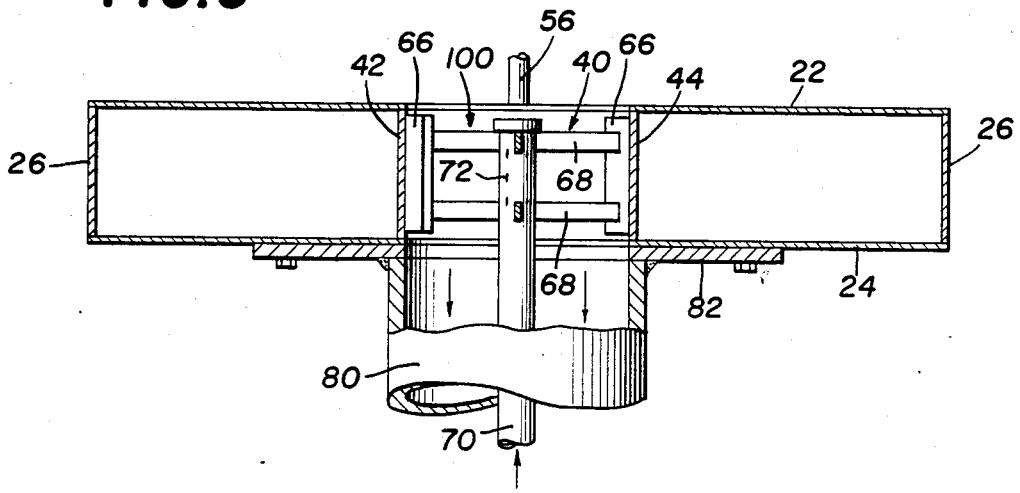
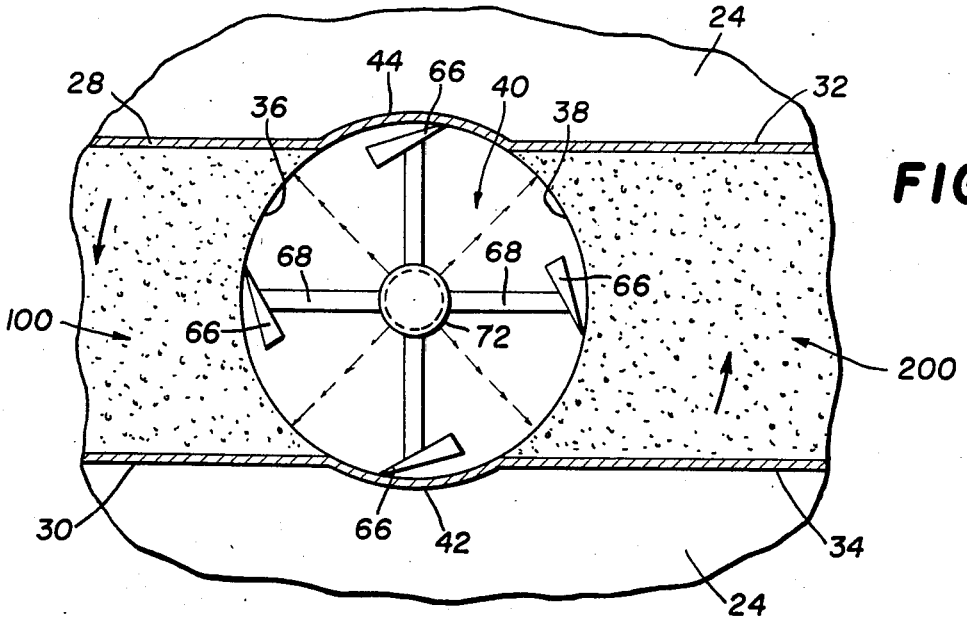
FIG. 6

CENTRIFUGAL SEPARATOR AND METHOD OF SEPARATING BUOYANT PARTICLES FROM A LIQUID

This invention relates to apparatus and methods of separating suspended solids from liquids. More particularly, this invention is concerned with the separation of solid particles dispersed in a liquid in which they float, and specifically the separation of ice crystals from an aqueous liquid.

BACKGROUND OF THE INVENTION

In the operation of commercial and industrial processes, it is common to produce a dispersion or slurry of solid particles in a liquid in which they float. Furthermore, it is often necessary or desirable to separate the solid particles from the liquid. One such dispersion or slurry which requires such separation is an aqueous liquid slurry of ice particles or crystals.

Various freeze processes have been developed to produce potable water from seawater, brackish water, or industrial waste waters; to concentrate fruit juices such as orange juice and grape juice, vegetable juices such as tomato juice; coffee; and to separate dissolved or suspended salts from the liquid carrier. See, for example, U.S. Pat. Nos. 3,070,969; 3,477,241; 3,501,924; 3,620,034; 3,664,145; and 4,091,635.

Many types of equipment and heat exchangers have been used in the described freeze concentration processes, some of which is disclosed in the patents listed above. More recently, shell and tube freeze exchangers have been developed for this purpose as disclosed in U.S. Pat. Nos. 4,286,436 and 4,335,581.

In producing a freeze concentrated aqueous product using a shell and tube vertical freeze exchanger, the product to be concentrated is generally precooled and then is fed into the top of the tubes. As it flows downwardly through the vertical tubes, it is further cooled by heat exchange with a cold fluid circulated through the shell side of the heat exchanger. The cold fluid is generally a refrigerant such as ammonia or a Freon brand refrigerant. As the aqueous liquid cools, ice crystals form. The mixture of cold aqueous liquid flows from the tubes into a receiving tank in which the ice separates as a slurry floating on concentrated aqueous liquid. Some of the concentrated aqueous liquid is generally recycled to the freeze exchanger to produce more ice, while the ice slurry is removed and washed to recover any product, such as a juice, on the ice. Of course, if potable water is desired, the ice is washed and then melted. The concentrated aqueous liquid in the receiving tank, for example, a juice, can be withdrawn and packaged.

Apparatus for separating and washing an ice slurry for the described purposes have been known in the art for a considerable period of time. One type of such apparatus is referred to as a gravity counterwasher. In this type of separator and washer, an ice slurry is introduced at the base of a vertical, cylindrical vessel. The buoyancy of the ice and the upward flow of the aqueous liquid cause the ice particles to rise, where they form a bed or pack. The aqueous liquid passes through the lower portion of the pack and discharges through drains located near the midpoint of the vessel. A pressure drop created by the liquid flow through the base of the ice pack causes the pack to rise, much like a piston in a cylinder. Fresh water is sprayed onto the top of the pack, displacing the concentrated aqueous liquid (the brine), thus washing the uppermost crystals. Cleaned ice is continuously scraped from the top of the ice pack. Such an apparatus is disclosed in U.S. Pat. No. 4,341,085.

Although counterwashers of the described type have seen considerable use, problems are encountered with their operation. To be functional, wash water must penetrate the top of the pack. The rate of penetration is limited by the acceleration of gravity and the flow resistance of the pack. This results in very large counterwashers, thereby raising capital costs, lengthening startup times and increasing heat transfer to the surroundings. Furthermore, significant wash water losses occur since some wash water travels through the pack directly to the drain. These losses are much greater than losses due to diffusion between wash water and concentrated liquid.

Operation of a counterwasher also requires a variation in pressure through the pack. This can result in non-uniform compression forces and high compressive loads in the region of the pack below the concentrated liquid drains. The permeability of ice decreases when the ice is subjected to high compression. The resulting low permeability can limit wash water penetration and can make column operation difficult. In addition, the high flow rate through this part of the pack can cause channel formation. When this occurs, slurry passes directly through the drains, there is no separation of ice and concentrated liquid, and the pack stops moving upward.

It is also recognized that counterwasher operating controls are limited to inlet and outlet flow parameters. Also, the height of the fresh water zone is very important to column operation. Small upsets in the rate of wash water drainage can change this height and have harmful effects on column operation and product quality. Successful, repeatable and optimal operation of a large scale counterwasher can be difficult to achieve.

From the above discussion it is believed clear that alternative apparatus and methods for separating solid particles from a liquid in which the particles float and, if desired, washing the separated solid particles would be useful, especially in separating ice crystals from an aqueous dispersion or slurry.

SUMMARY OF THE INVENTION

According to one aspect of the invention, a method of separating solid particles from a liquid dispersion in which the solid particles float is provided comprised of subjecting the dispersion to centrifugal force in a chamber thereby causing the buoyant solid particles to move radially inwardly and produce a pack of the solid particles while the liquid freed of solid particles flows radially outwardly; continuously withdrawing aqueous liquid freed of solid particles from the chamber; and continuously removing solid particles from the pack of solid particles.

The pack of solid particles develops a substantial radial depth. As the pack builds up, solid particles are desirably removed continuously from a radially inward portion thereof. The solid particles can be removed by continuously scraping the pack inward surface.

If it is advantageous, a liquid can be sprayed onto the pack inward surface to wash the pack as the liquid flows radially outwardly through the pack due to the centrifugal force applied to the pack and aqueous liquid.

The liquid dispersion in which solid particles are floating can be fed into a plurality of elongated chambers, having a longitudinal center line or axis substantially lateral to an axis of rotation for the chambers, while the chambers are rotated about said axis to apply centrifugal force to the liquid in the chambers thereby causing the buoyant or floating solid particles to move radially inward and produce a pack of solid particles in each chamber while the liquid thereby freed of solid particles flows radially outward. The chambers are generally desirably rigidly connected together in uniformly spaced apart arrangement.

Each chamber can terminate in a radially inward open end. Also, each pack can have a radially inward surface which is maintained at or extends radially inward from said open end by the continuous removal of solid particles from said pack surface.

The described method is particularly useful for separating ice crystals dispersed in an aqueous liquid.

According to a second aspect of the invention, apparatus for centrifugal separation of solid particles from a liquid dispersion is provided comprising a chamber adapted to be rotated about an axis; means to continuously feed a dispersion of solid particles in a liquid to the chamber; means to continuously withdraw liquid substantially free of solid particles from the chamber; and means to continuously remove solid particles from a pack of the solid particles which forms in the chamber as a result of centrifugal force when the chamber is rapidly rotated.

The means to continuously remove solid particles from the pack can be a scraper mounted to shear solid particles from the pack when the pack protrudes from the chamber.

The apparatus desirably also includes a spray means to spray a liquid onto the pack as the chamber rotates to thereby wash the pack.

More specifically, the invention provides apparatus for centrifugal separation of ice crystals from an aqueous liquid, comprising a body adapted to be rotated about an axis, said body having a plurality of elongated chambers, with each chamber having a longitudinal center line substantially lateral to the body axis of rotation; means to continuously feed an aqueous liquid containing ice crystals to the chamber; each chamber terminating in a radially inward open end out of which the top of an ice pack formed in the chamber can move continuously; and means to scrape ice from the top of the pack as it moves radially inwardly by centrifugal force as the body is rotated. The apparatus can include means to spray wash water onto the ice pack at the inward open end.

BRIEF DESCRIPTION OF THE DRAWINGS

FIG. 4 is a sectional view taken along the line 4—4 of FIG. 3;

FIG. 5 is a sectional view taken along the line 5—5 of FIG. 3; and

FIG. 6 is a sectional view taken along the line 6—6 of FIG. 4.

DETAILED DESCRIPTION OF THE DRAWINGS

To the extent it is reasonable and practical, the same elements or parts which appear in the various views of the drawings will be identified by the same numbers.

In the subsequent description of the drawings, use of the centrifugal separator for separating ice crystals from an aqueous dispersion or slurry will also be discussed.

Figure 1:
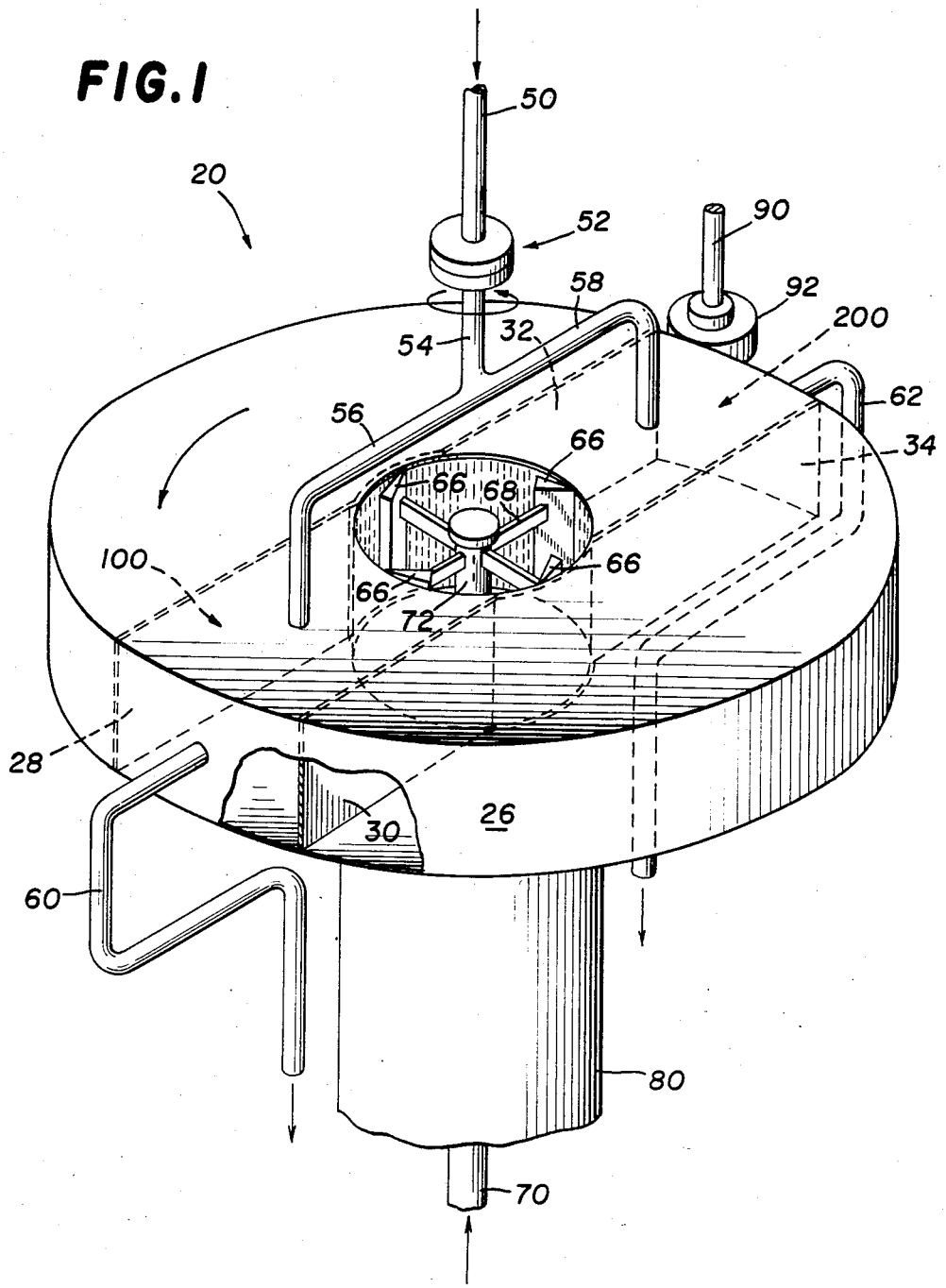
FIG. 1 is an isometric view of a centrifugal apparatus according to the invention.
Figure 2:
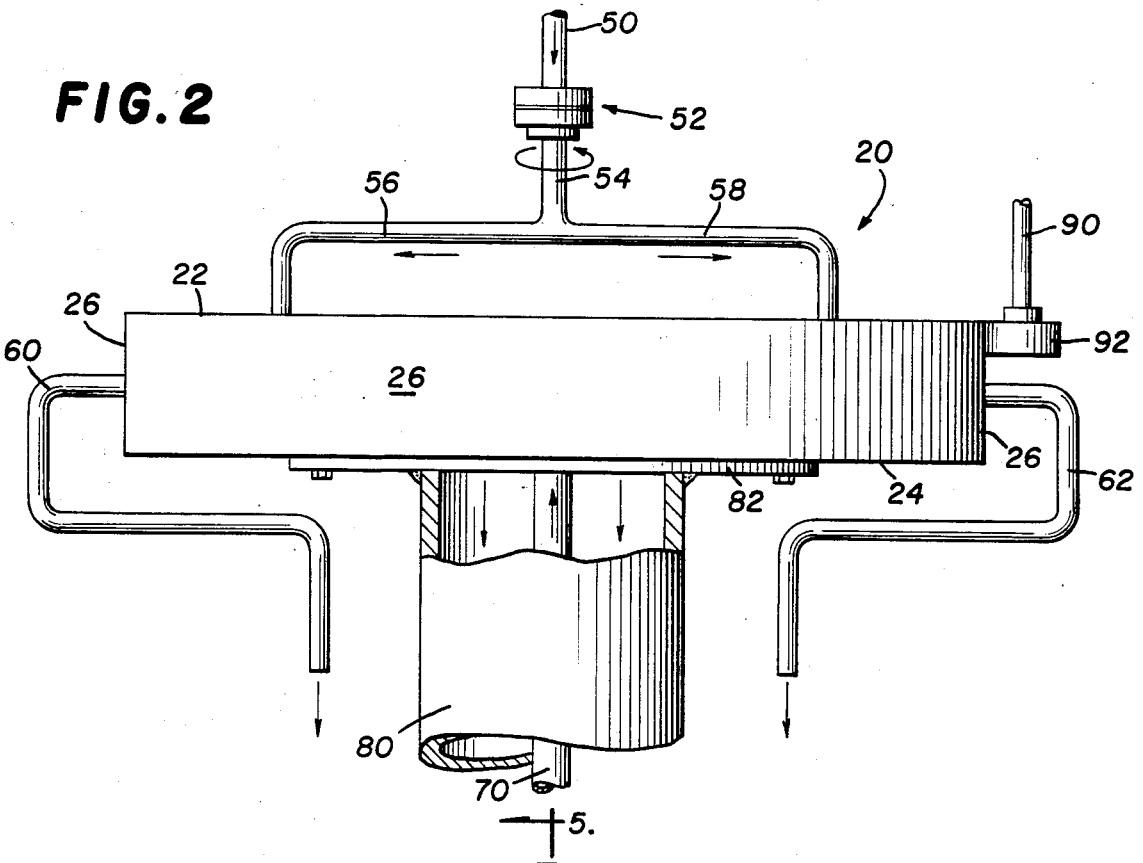
FIG. 2 is an elevational view, partially broken away and in section, of the centrifugal apparatus shown in FIG. 1.
Figure 3:
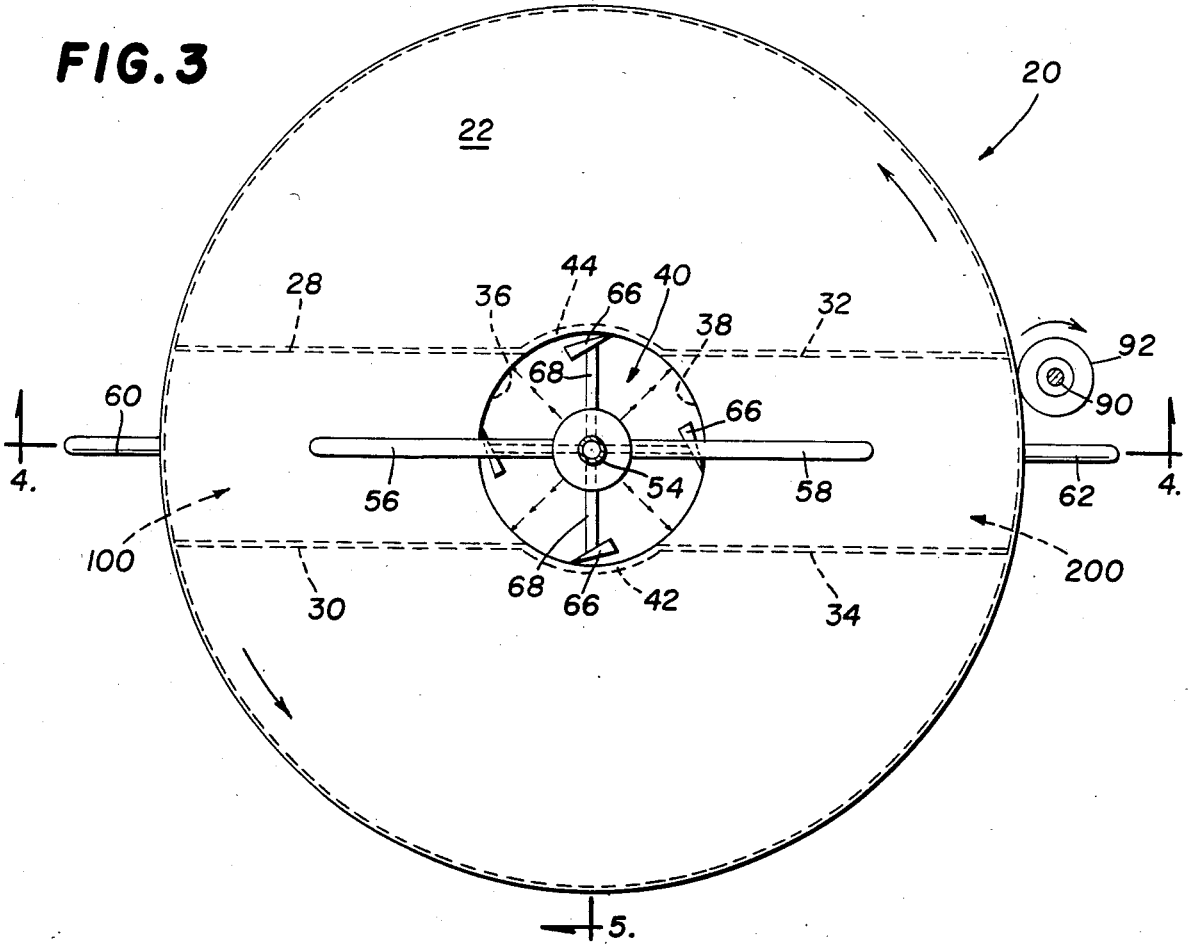
FIG. 3 is a plan view of the apparatus shown in FIGS. 1 and 2.

The centrifugal separator apparatus 20 has a flat circular horizontal top plate 22, a flat circular horizontal bottom plate 24 and a circular cylindrical wall 26 connected at its edges to plates 22 and 24 (FIGS. 1 to 3). A pair of spaced apart vertical parallel walls 28 and 30 are mounted between and joined to top and bottom plates 22 and 24 and together the sidewalls and portions of the top and bottom plates between the sidewalls define a chamber 100 (FIGS. 3, 4 and 6). Similarly, a pair of sidewalls are defined by spaced apart vertical parallel plates 32 and 34 mounted between and joined to top and bottom plates 22 and 24. Chamber 200 is defined by the plates 32 and 34 and the portions of the top and bottom plates 22 and 24 (FIGS. 3, 4 and 6). The radially outer end of each chamber 100 and 200 is closed by a portion of cylindrical wall 26. The inner ends 36 and 38 (FIG. 6) of chambers 100 and 200 are open between the top and bottom plates 22 and 24 and the respective side plates defining the chambers.

The open inner ends of the chambers 100 and 200 communicate with a vertical hole 40 axially positioned in the centrifugal separator 20. The hole 40 is partly defined by a pair of opposing vertical arced plates 42 and 44 which are curved to coincide with the radius of hole 40 (FIGS. 3, 5 and 6). The vertical edges of plate 42 are joined to the inner ends of side plates 30 and 34. Similarly, the vertical edges of plate 44 are joined to side plates 28 and 32. Chambers 100 and 200 are essentially identical in size and shape and are located diametrically opposite each other equally spaced from the vertical axis of the separator 20. As is evident from the above discussion, the diameter of hole 40 is slightly greater than the width of chambers 100 and 200 between their respective sidewalls.

Liquid feed conduit 50 communicates with fluid swivel 52 to which conduit 54 is rotatably connected (FIGS. 1 and 2). The lower end of conduit 54 is joined by a T-branch to conduit arms 56 and 58. The end of conduit 56 communicates with the upper central portion of chamber 100. Similarly, the end of conduit 58 communicates with the upper central portion of chamber 200.

A conduit 60 extends radially outwardly from communication with the outer end of chamber 100 and then bends back under the separator 20 (FIGS. 1 to 4). A similar conduit 62 extends radially outwardly from communication with the outer end of chamber 200 and then bends back under the separator 20. The conduits 60 and 62 serve to withdraw aqueous liquid freed of ice crystals, from their respective chambers 100 and 200.

One or more ice scraper blades 66 is vertically mounted in hole 40 with the scraping edge of the blade positioned to be near the open inner end or mouth of each chamber 100 and 200 when separator 20 rotates (FIGS. 3 to 6). The ice scraping blades 66 can be stationary, or mounted to rotate in the same direction as, but at a different speed than, separator 20, or in the opposite direction.

Conduit 70 extends vertically upwards and terminates in a spray head 72 located in hole 40 (FIGS. 4 to 6). Conduit 70 can be stationary. The scraper blades 66 are mounted on spray head 72 by spokes 68. In the event it is intended to use the ice separator 20 for the additional purpose of washing the separated ice, potable water can be sprayed out of spray head 72 continuously against the ice in chambers 100 and 200.

Vertical circular column 80 has a lateral ring-like flange 82 at the top which is removably bolted or otherwise axially connected to the bottom plate 24 (FIGS. 2, 4 and 5). Column 80 has an internal diameter the same as, or larger than, hole 40 so that ice can fall freely through the column into a receiving vessel, not shown. The lower end of column 80 is mounted in a conventional bearing support (not shown) which permits the column 80 and separator 20 to rotate as a unit.

The separator 20 can be rotatably powered by a number of conventional mechanisms. One such mechanism is shown in FIGS. 2 and 3. Vertical shaft 90 has a drive wheel fixedly connected on its lower end so as to frictionally engage wall 26 of separator 20. Shaft 90 is connected to a gear box (not shown) which in turn is operatively connected to an electrically powered motor, also not shown. When drive wheel 92 rotates it propels separator 20 which rotates about a vertical axis.

The operation of the described apparatus is quite simple. A concentrated aqueous liquid containing ice crystals is supplied under pressure by conduit 50, through fluid coupling 52 to conduit 54 which feeds it to conduits 56 and 58 for delivery to chambers 100 and 200 in equal amounts. Separator 20 is rotated as the aqueous liquid containing ice crystals is fed to the chambers. In general, the feed stream is in the nature of an ice slurry, quite rich in ice crystals. Centrifugal action develops a buoyant force causing the ice to move radially inwards in chambers 100 and 200 while aqueous liquid freed of ice moves radially outwardly in the chambers and is removed therefrom through conduits 60 and 62. The ice crystals compact to form a pack. The buoyant force exerted on the ice pack pushes the pack radially inward, overcoming the dead weight of any drained ice. Ice at the inner end of the separator is continuously shaved off by the blades. When desirable, potable wash water can be sprayed onto the ice pack to wash it before it is shaved from the pack. The centrifugal action forces the wash water to move radially outward through the drained section of the ice pack in each chamber where a sharp interface is established between the wash water and the concentrated liquid. Additional wash water is continuously added to make up for diffusion and mixing losses in order to maintain a stable interface.

Although the described apparatus has two chambers 100 and 200, only one such chamber need be used if desired. The other chamber could be blocked off but filled with liquid or counterweights to provide balance when the separator 20 spins. Additionally, three, four or more chambers can be provided in the separator. They should, of course, be sized and arranged to provide balance when the separator is rotated rapidly. Furthermore, instead of being square or rectangular in lateral section, the chambers can be circular, eliptical, triangular or of any other suitable cross-sectional shape.

Some of the advantages of the described separator and washer, especially over the prior art gravity counterwashers, may be summarized as follows:

1. Size Reduction: The magnitude of centrifugal acceleration can far exceed that of gravity. The rise rate of ice (single crystals and pack) and also the wash water penetration rate are proportional to this acceleration. The maximum ice velocity of the centrifugal separator is thus theoretically much higher than that of conventional columns. The increased production per unit area permits much smaller units, thereby lowering capital costs, start up times and heat leak.

2. Decreased Wash Water Loss: Since the slurry feed line enters the separator between the ice outlet and the concentrated liquid drain, the direct flow of wash water to the drains is eliminated. Thus, wash water losses would be primarily confined to diffusion losses in the ice pack.

3. Increased Control Capability: The driving force on the ice pack can be varied quickly and easily by varying the rotational speed. As in the conventional counterwasher, the slurry feed, concentrated liquid discharge, and wash water supply can be controlled.

4. Uniform Compaction: Since that part of the pack below the liquid level is accelerated by buoyancy, compressive loads should be more evenly distributed through the pack. This should result in more uniform compaction and higher permeability. Since concentrated liquid does not flow through the pack, channeling is virtually eliminated.

5. Dense Solid Removal: For applications in which dense solids are formed (e.g. precipitation), they could be removed in the same step as ice washing.

The foregoing detailed description has been given for clearness of understanding only, and no unnecessary limitations should be understood therefrom, as modifications will be obvious to those skilled in the art.

What is claimed is:

1. A method of separating solid particles present in a liquid in which they are buoyant comprising:

feeding a liquid containing the solid particles into a plurality of elongated chambers having a longitudinal center line substantially lateral to an axis of rotation while the chambers are rotated about said axis to apply centrifugal force on liquid in the chambers thereby causing the buoyant solid particles to move radially inward and produce a pack in each chamber while the liquid thereby freed of solid particles flows radially outwardly;

continuously withdrawing liquid freed of solid particles from the chambers; and continuously removing solid particles from the packs in the chambers.

2. A method of separating ice present in an aqueous liquid comprising:

subjecting an aqueous liquid containing small ice crystals to centrifugal force in a chamber thereby causing the buoyant ice crystals to move radially inwardly and produce an ice pack while the aqueous liquid freed of ice flows radially outwardly;

continuously withdrawing aqueous liquid freed of ice from the chamber; and continuously removing ice from the ice pack.

3. A method according to claim 2 in which the ice pack has a radial depth and ice is continuously removed from a radially inward portion thereof.

4. A method according to claim 3 in which the ice pack has a radially inward surface and ice is removed by continuously scraping the ice pack inward surface.

5. A method of separating ice present in an aqueous liquid comprising:

feeding an aqueous liquid containing ice crystals into a plurality of elongated chambers having a longitudinal center line substantially lateral to an axis of rotation while the chambers are rotated about said axis to apply centrifugal force on aqueous liquid in the chambers thereby causing the buoyant ice crystals to move radially inwardly and produce an ice pack in each chamber while the aqueous liquid thereby freed of ice flows radially outwardly;

continuously withdrawing aqueous liquid freed of ice from the chambers; and continuously removing ice from the ice packs in the chambers.

6. A method according to claim 5 in which each chamber terminates in a radially inward open end and the ice pack has a radially inward surface which is maintained at or extending radially inward from said open end by the continuous removal of ice from said ice surface.

7. A method according to claim 6 in which the radially inward surfaces of the ice pack are continuously scraped to remove ice.

8. A method according to claim 8 in which water is sprayed onto the ice pack inward surfaces and the water washes the ice pack as it flows radially outwardly through the ice pack due to the centrifugal force applied to the ice pack and aqueous liquid.

9. A method according to claim 5 in which the chambers are rigidly connected together in regularly spaced apart arrangement.

10. Apparatus for centrifugal separation of ice crystals from an aqueous liquid, comprising:

a body adapted to be rotated about an axis, said body having a plurality of elongated chambers, with each chamber having a longitudinal center line substantially lateral to the body axis of rotation;

means to continuously feed an aqueous liquid containing ice crystals to the chambers;

each chamber terminating in a radially inward open end out of which the top of an ice pack formed in the chamber can move continuously; and means to scrape ice from each top of the pack as it moves radially inwardly by centrifugal force as the body is rotated.

11. Apparatus according to claim 10 including means to spray water onto the ice pack as the chambers rotate thereby washing the ice.

12. A method of separating solid particles present in a liquid in which the solid particles float comprising:

subjecting a liquid containing floating solid particles less dense than the liquid to centrifugal force in a chamber thereby causing the solid particles to move radially inwardly and produce a pack having a radial depth of solid particles with a radial inward surface while the liquid freed of solid particles flows radially outwardly;

continuously withdrawing liquid freed of solid particles from the chamber; and continuously removing solid particles from the radially inward portion of the pack by scraping the pack entire inward surface.

13. A method according to claim 12 in which a liquid is sprayed onto the pack inward surface and the liquid washes the pack as it flows radially outwardly through the pack due to the centrifugal force applied to the pack and liquid.

14. A method of separating ice crystals present in an aqueous liquid in which they are buoyant comprising:

feeding an aqueous liquid containing the ice crystals into an elongated chamber having a longitudinal center line substantially lateral to an axis of rotation while the chamber is rotated about said axis to apply centrifugal force on aqueous liquid in the chamber thereby causing the buoyant ice crystals to move radially inward and produce an ice pack having a radial depth in the chamber while the aqueous liquid thereby freed of ice crystals flows radially outwardly;

continuously withdrawing aqueous liquid freed of ice crystals from the chamber; and continuously removing ice from a radially inward portion of the ice pack in the chamber.

15. A method according to claim 14 in which the ice pack has a radially inward surface and ice is removed by continuously scraping the ice pack entire inward surface.

16. A method of separating ice present in an aqueous liquid comprising:

subjecting an aqueous liquid containing small ice crystals to centrifugal force in a chamber thereby causing the bouyant ice crystals to move radially inwardly and produce an ice pack having a radial depth and a radial inward surface while the aqueous liquid freed of ice flows radially outwardly;

continuously withdrawing aqueous liquid freed of ice from the chamber;

continuously removing ice from the ice pack by scraping the ice pack radial inward surface; and spraying water onto the ice pack inward surface whereby the water washes the ice pack as it flows radially outwardly through the ice pack due to the centrifugal force applied to the ice pack and aqueous liquid.

17. Apparatus for centrifugal separation of solid particles from a liquid in which they are buoyant, comprising:

a chamber adapted to be rotated about an axis;

means to continuously feed liquid containing the solid particles to the chamber;

means to continuously withdraw liquid substantially free of solid particles from the chamber;

a scraper to continuously remove solid particles from a pack of solid particles which forms in the chamber as a result of centrifugal force when the chamber is rapidly rotated;

said pack having a radial depth and a radial inward surface; and the scraper is mounted to shear solid particles from the entire radial inward surface of the pack when the pack inward surface protrudes from the chamber.

18. Apparatus for centrifugal separation of solid particles from a liquid in which they are buoyant, comprising:

a chamber adapted to be rotated about an axis;

means to continuously feed liquid containing the solid particles to the chamber;

means to continuously withdraw liquid substantially free of solid particles from the chamber;

means to continuously remove solid particles from a pack of solid particles which forms in the chamber as a result of centrifugal force when the chamber is rapidly rotated; and a spray means to spray liquid onto the pack as the chamber rotates to thereby wash the pack.

19. Apparatus for centrifugal separation of solid particles from a liquid, comprising:

a body adapted to be rotated about an axis;

said body having an elongated chamber, with the chamber having a longitudinal center line substantially lateral to the body axis of rotation;

means to continuously feed a liquid containing the solid particles to the chamber;

the chamber terminating in a radially inward open end out of which the top of a pack of solid particles formed in the chamber can move continuously; and means to shear solid particles from the top of the pack as it moves radially inwardly by centrifugal force as the body is rotated.

20. Apparatus according to claim 19 including means to spray a liquid onto the pack as the chamber rotates thereby washing the pack of solid particles.

* * * * *

UNITED STATES PATENT AND TRADEMARK OFFICE

CERTIFICATE OF CORRECTION

PATENT NO. : 4,648,864

DATED : March 10, 1987

INVENTOR(S) : Timothy J. Evans et al

It is certified that error appears in the above-identified patent and that said Letters Patent is hereby corrected as shown below:

Column 7, line 42, change "each top of the pack" to -- the top of each pack --.

Signed and Sealed this

Fifteenth Day of September, 1987

*Attest:*

DONALD J. QUIGG

*Attesting Officer*

*Commissioner of Patents and Trademarks*